US005123214A

United States Patent [19]

Ishimura et al.

[11] Patent Number: 5,123,214

[45] Date of Patent: Jun. 23, 1992

[54] METHOD OF GRINDING A PLATE-LIKE MATERIAL AND APPARATUS FOR CARRYING OUT THE METHOD

[75] Inventors: Kazuhiko Ishimura, Yokohama; Mituhiro Higashizaki, Sakurai; Nobuo Hasegawa, Ibaragi, all of Japan

[73] Assignee: Asahi Glass Company, Ltd., Tokyo, Japan

[21] Appl. No.: 560,821

[22] Filed: Jul. 31, 1990

[30] Foreign Application Priority Data

Aug. 2, 1989 [JP] Japan ..... 1-200547

[51] Int. Cl.[5] ..... B24B 49/00

[52] U.S. Cl. ..... 51/165.77; 51/283 R; 51/131.3

[58] Field of Search ..... 51/281 R, 111 R, 112, 51/131.1, 131.2, 131.3, 80 R, 80 A, 88, 165.77, 215 R, 283 R

[56] References Cited

U.S. PATENT DOCUMENTS 1,666,347 9/1968 Platt .
2,963,830 12/1960 Hook ..... 51/131.2
3,991,522 11/1976 Hedlund et al. ..... 51/215 E
4,079,551 3/1978 Bando ..... 57/110
4,447,990 5/1984 Nepomiastchy et al. ..... 51/215 E

FOREIGN PATENT DOCUMENTS 312510 9/1982 European Pat. Off. .
618375 4/1983 Switzerland .
6910026 4/1981 Taiwan .

*Primary Examiner*—M. Rachuba
*Attorney, Agent, or Firm*—Oblon, Spivak, McClelland, Maier & Neustadt

[57] ABSTRACT

A method of grinding a plate-like material comprises supporting a plate-like material on a circular carrying member having a gear at its outer circumference, engaging the gear of the circular carrying member with first and second transferring means which oppose at a predetermined distance, grinding a surface of the plate-like material in a grinding unit placed at or near a transferring path which is formed between the first and second transferring means by moving the carrying member which is driven by the first and second transferring means, and moving the carrying member from the grinding unit by driving the first and second transferring means after the completion of the grinding operation.

3 Claims, 7 Drawing Sheets

METHOD OF GRINDING A PLATE-LIKE MATERIAL AND APPARATUS FOR CARRYING OUT THE METHOD

The present invention relates to a method of grinding a plate-like material and an apparatus for carrying out the method. More particularly, it relates to such method and apparatus for grinding continuously a circular plate-like material such as a disk of glass which is used for a magnetic disk or an optical magnetic disk.

In general, an apparatus for grinding a disk of glass or the like which is used for a magnetic disk or an optical magnetic disk comprises a ring gear 10, carriers 12, a sun gear 14 and so on as shown in FIG. 7. A gear 12A is formed at the outer circumference of each of the carriers 12, the gear 12A is engaged with the internal gear 10A of the ring gear 10 and the external gear 14A of the sun gear 14. A plurality of openings 12B, 12B . . . are formed in the carriers 12 and each of the openings 12B is adapted to hold a circular disk 16.

As shown in FIG. 8, since the thickness L1 of the circular disk 16 is larger than the thickness L2 of the carrier 12, a surface facing upward (referred to as a front surface) 16A and a surface facing downward (referred to as a back surface) 16B project the front surface 12C and the back surface 12D of the carrier 12. Accordingly, the grinding operation of the circular disk is carried out as follows. The circular disk 16 is held by a lower grinding plate 20 and an upper grinding plate 18 in the vertical direction as shown in FIG. 8. The lower and upper grinding plates 20, 18 are rotated, and at the same time, the ring gear 10 or the sun gear 14 is rotated whereby the carrier 12 is rotated in the direction indicated by arrow marks A and is revolved in the direction indicated by arrow marks B as shown in FIG. 7. Thus, the front surface 16A of the circular disk is ground by the upper grinding plate 18, and the back surface 16B is grounded by the lower grinding plate 20.

In the conventional grinding apparatus, however, when the circular disk 16 is removed by manual operation from the upper grinding plate 18 after the grinding apparatus has been stopped and the upper grinding plate 18 has been ascended, the circular disk 16 sometimes sticks on the lower surface of the upper grinding plate to cause difficulty in the removal of the circular disk. Accordingly, a continuous grinding operation becomes often impossible and productivity is low.

It is an object of the present invention to eliminate the above-mentioned problem and to provide a method of grinding a plate-like material capable of continuously grinding the plate-like material such as a circular disk made of glass and an apparatus for carrying out the method.

In accordance with the present invention, there is provided a method of grinding a plate-like material which comprises supporting a plate-like material on a circular carrying member having a gear at its outer circumference, engaging the gear of the circular carrying member with first and second transferring means which oppose at a predetermined distance, grinding a surface of the plate-like material in a grinding unit placed at or near a transferring path which is formed between the first and second transferring means by moving the carrying member which is driven by the first and second transferring means, and moving the carrying member from the grinding unit by driving the first and second transferring means after the completion of the grinding operation.

In accordance with the present invention, there is provide a grinding apparatus for grinding a plate-like material which comprises a circular carrying member having a gear at its outer circumference and an opening for supporting a plate-like material, first and second transferring means which are arranged so as to oppose at a predetermined distance in which a transferring path is formed, and have first and second engaging portions which are engaged with the gear of the carrying member so as to move the carrying member by driving the first and second transferring means, and a grinding unit arranged at or near the transferring path so as to grind a surface of the plate-like material.

Preferred embodiments of the grinding method of a plate-like material and the apparatus for carrying out the grinding method of the present invention will be described with reference to the drawings.

Figure 1:
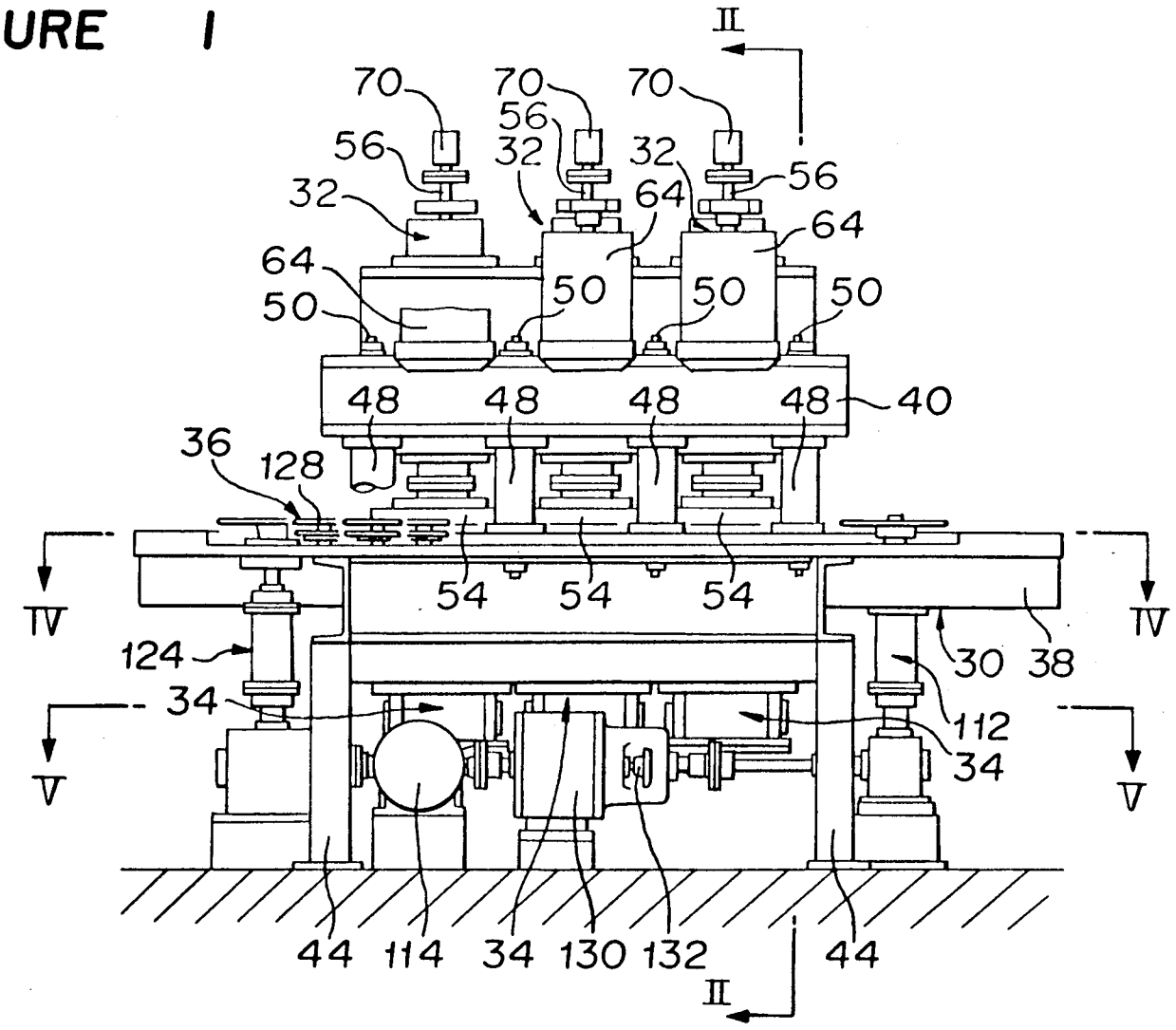
FIG. 1 is a front view of an embodiment of the apparatus for grinding a plate-like material in accordance with the present invention.
Figure 2:
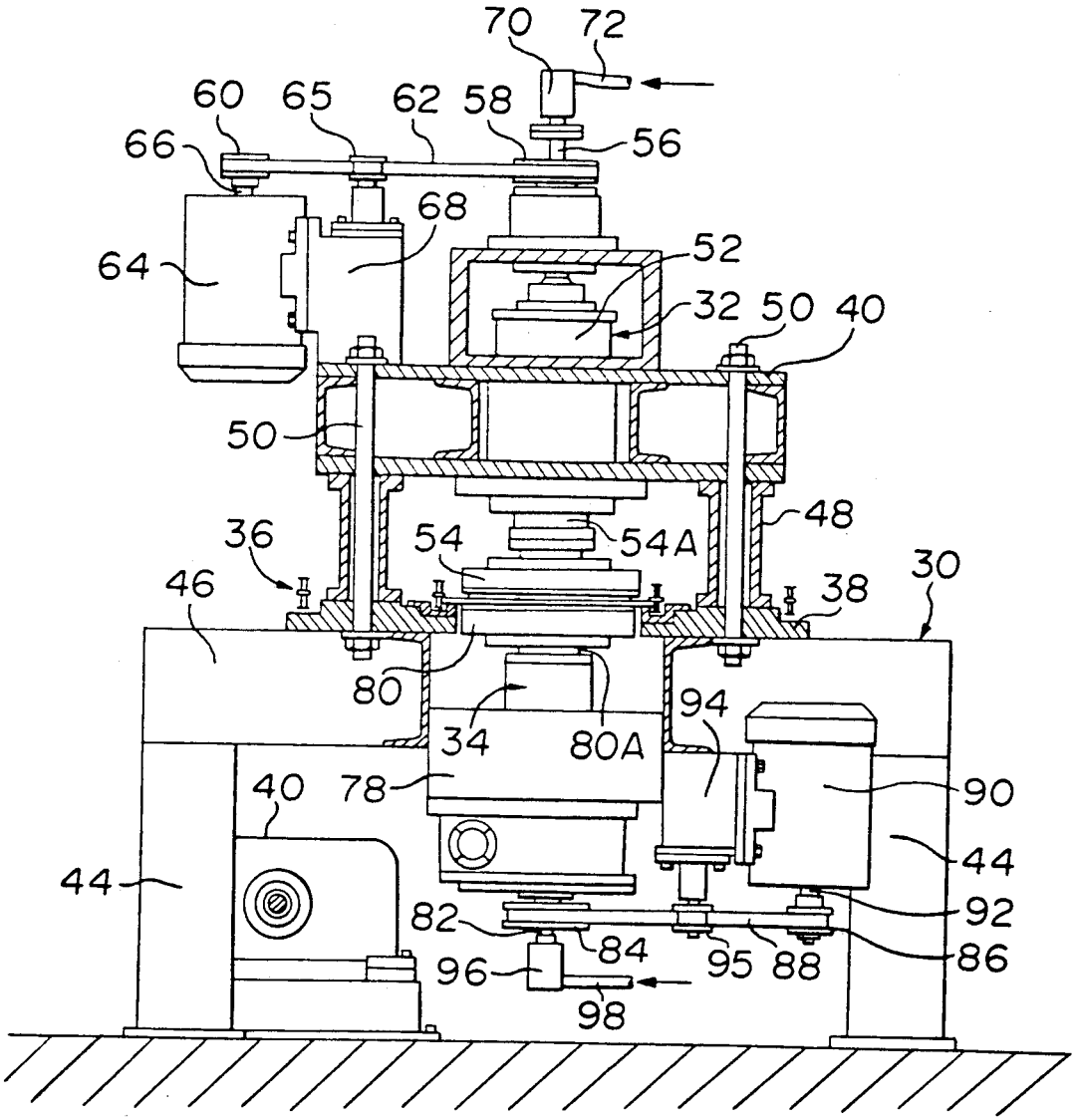
FIG. 2 is a cross-sectional view taken along a line II—II in FIG. 1.
Figure 4:
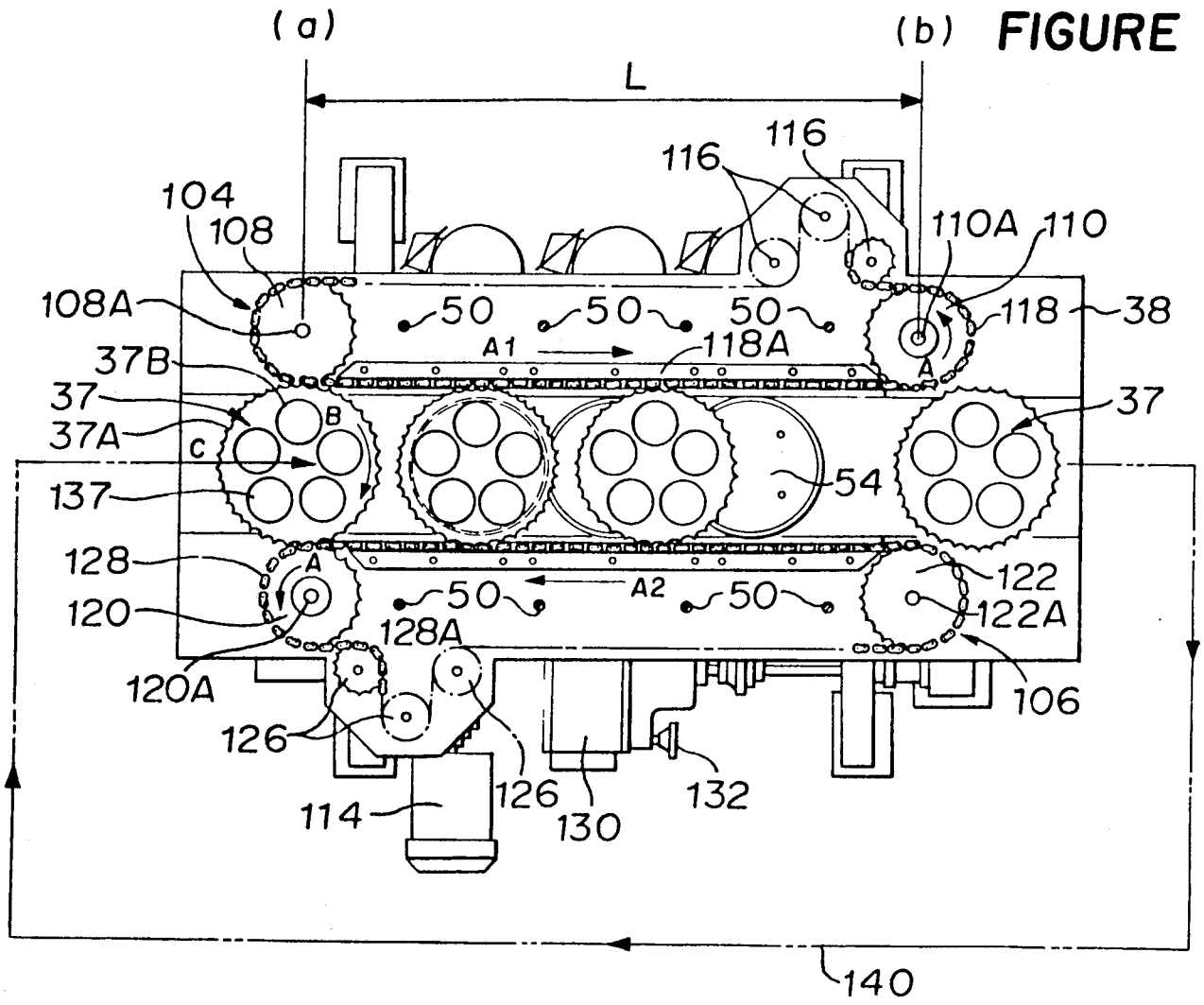
FIG. 4 is a cross-sectional view taken along a line IV—IV in FIG. 1.

The grinding apparatus for a plate-like material of the present invention comprises a frame 30, upper grinding units 32, lower grinding units 34, a transferring means 36 (as shown in FIGS. 1 and 2) and carriers 37 (as shown in FIG. 4) and so on.

The frame 30 comprises a lower frame 38 and an upper frame 40 as shown in FIG. 2. The lower frame 38 comprises four support legs 44 and horizontal beams 46 extended between the four support legs 14. The upper frame 40 is mounted on the lower frame 38 by interposing distance members 48 therebetween and fixed by bolts 50.

As shown in FIG. 1, the upper grinding units 32 are linearly arranged on the upper frame 40 at equal distances with their axial line directing upwardly. Each of the upper grinding units 32 has a main body 52 and a shaft 54A extending from the main body 52 in the downward direction. A circular plate-like upper plate 54 is rotatably supported by the shaft 54A at its lower end as shown in FIG. 2.

Figure 6:
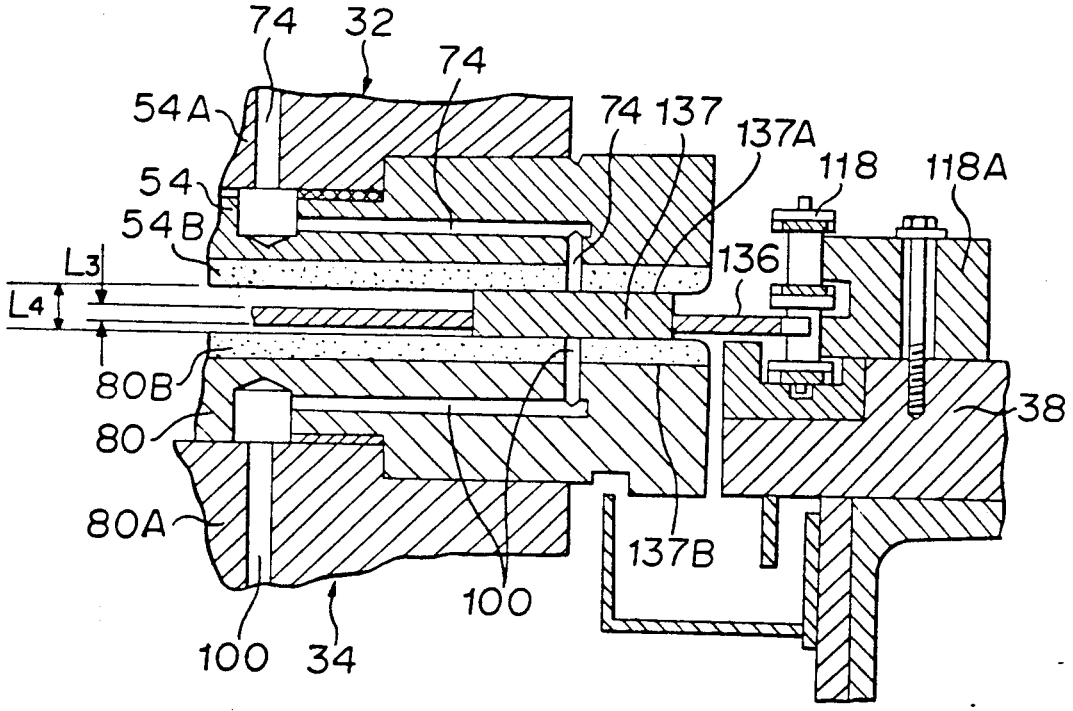
FIG. 6 is an enlarged cross-sectional view of an important portion of the apparatus as shown in FIG. 2.
Figure 7:
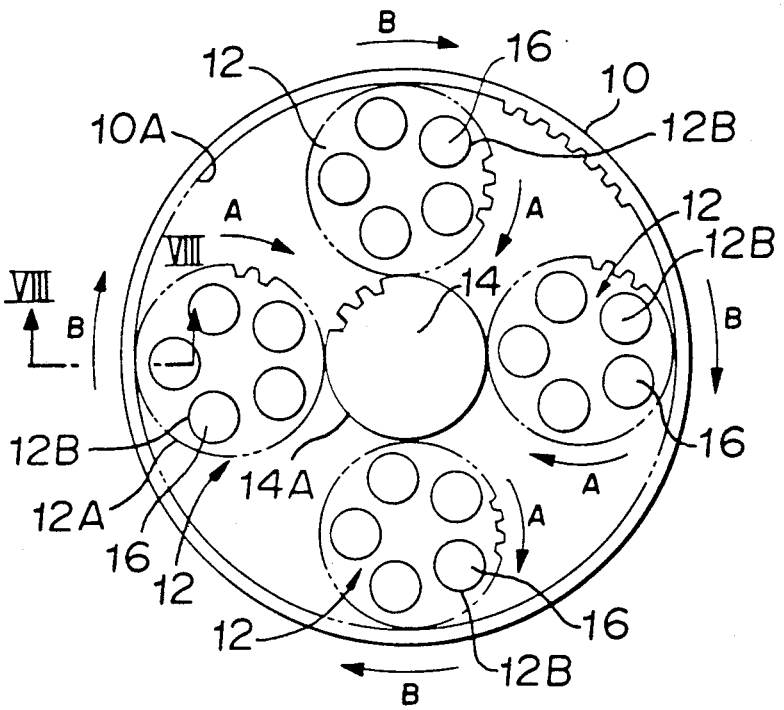
FIG. 7 is a plane view of a conventional grinding apparatus wherein the upper grinding plate is omitted.
Figure 8:
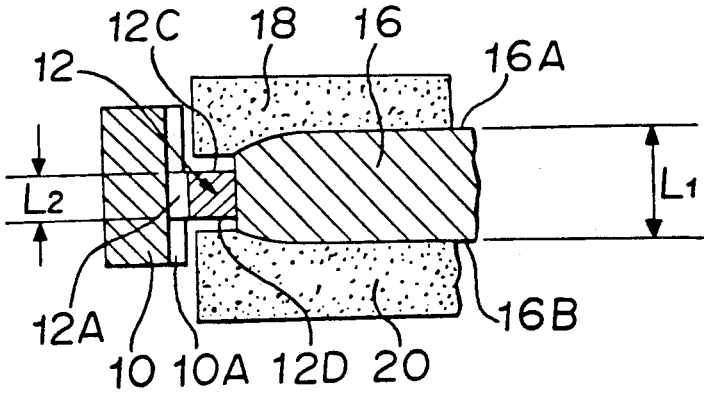
FIG. 8 is a cross-sectional view taken along a line VIII—VIII in FIG. 7.

As shown in FIG. 6, a grinding pad 54B such as a foamed urethane pad is attached to the lower surface of the upper plate 54. The shaft 54A is connected to a shaft 56 extending to the upper part of the main body 52 so as to transmit a rotational force.

Figure 3:
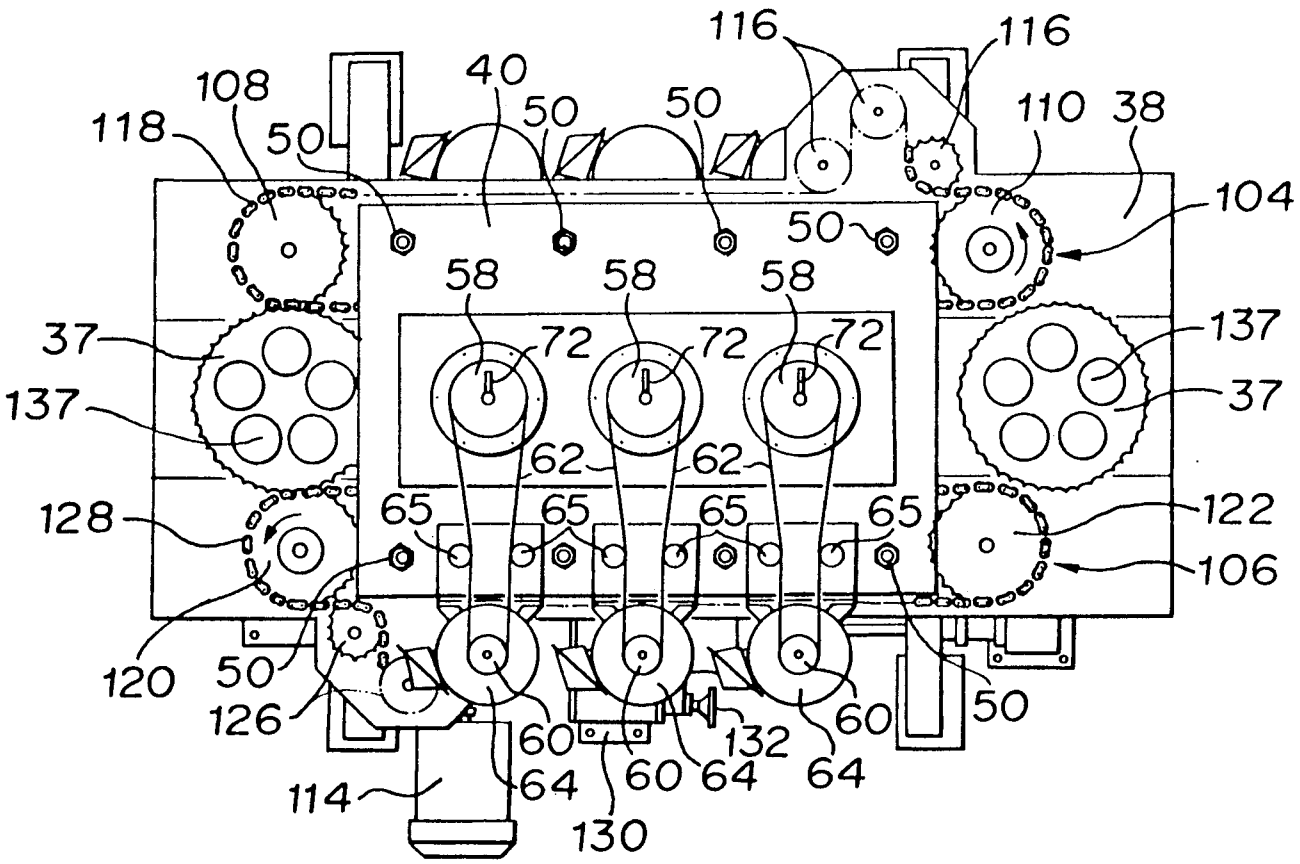
FIG. 3 is a plane view of the grinding apparatus as shown in FIG. 1.

In FIG. 2, an endless belt 62 is extended between a pulley 58 which is fixed to the shaft 56 and a pulley 60 which is fixed to the shaft 66 of a driving motor 64. The driving motor 64 is mounted on a bracket 68 which is fixed to the upper surface of the upper frame 40. A rotating force produced by the driving motor 64 is transmitted to the upper plate 54 through the shaft 66, pulley 60, belt 62, pulley 58, shaft 56, and shaft 54A. In FIGS. 2 and 3, a numeral 65 designates a pulley for adjusting a tension to the belt 62.

As shown in FIG. 2, an abrasive supplying pipe 72 is connected to the shaft 56 of the upper grinding unit 32 through a rotary joint 70. The supplying pipe 72 is communicated with discharge conduits formed in the shaft 54A, the upper plate 52 and the grinding pad 54B as shown in FIG. 6. Accordingly, abrasives supplied from the supplying pipe 72 is discharged through the discharge conduit 74 opened at the grinding surface of the grinding pad 54B.

Each of the upper grinding units 32 is adapted to vertically move the upper plate 54 and to adjust a grinding pressure by a mechanism (not shown).

As shown in FIG. 1, each of the lower grinding units 34 is disposed on the same axial line of each of the upper grinding units 32. A lower plate 80 having a circular shape is rotatably supported by a shaft 80A which extends from the main body 78 of each of the lower grinding units 34. As shown in FIG. 6, a grinding pad 80B such as a foamed urethane pad is attached to the upper surface of the lower plate 80 so as to face the grinding pad 80B. The shaft 54B is connected to the main body 78 so as to transmit a rotating force to a shaft 82 which extends downwardly from the main body 78 in a coaxial manner.

A pulley 84 is firmly attached to the shaft 82 and an endless belt 88 is extended between the pulley 84 and a pulley 86 which is firmly attached to a shaft 92 extending from a driving motor 90. The driving motor 90 is mounted on a bracket 94 attached to one of the support legs 44. When the driving motor 90 is actuated, the rotating force is transmitted to the lower plate 80 through the shaft 92, the pulley 86, the belt 88, the pulley 84, the shaft 82 and the shaft 80A. In FIG. 2, a numeral 95 designates a pulley for adjusting a tension to the belt 88.

In FIG. 2, a rotary joint 96 is attached to the shaft 82 of each of the lower grinding units 34. An abrasive supplying pipe 98 is connected to the rotary joint 96. The abrasive supplying pipe 98 is communicated with discharge conduits 100 formed in the shaft 80A, the lower plate 80 and the grinding pad 80B as shown in FIG. 6 so that an abrasive agent supplied from the supplying pipe 98 is discharged through the discharge conduit 100 which opens at the grinding surface of the grinding pad 80B. Each of the lower grinding units 34 can finely adjust the movement of the lower plate 80 in the vertical direction by a mechanism (not shown).

Figure 5:
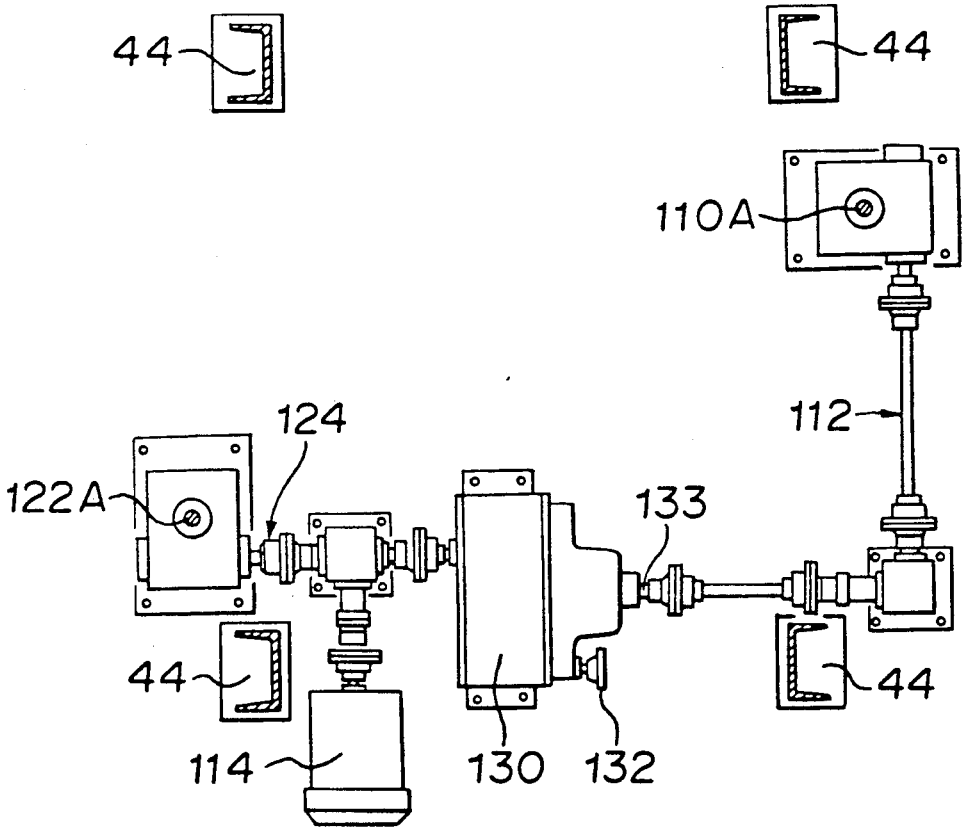
FIG. 5 is a cross-sectional view taken along a line V—V in FIG. 1.

The transferring means 36 as shown in FIG. 1 is well illustrated in FIGS. 3 and 4. The transferring means 36 comprises a first and second transferring members 104, 106 which oppose with a predetermined space so as to form a transferring path through which the carriers 7 are moved. The first transferring member 104 comprises sprockets 108, 110 wherein the sprocket 108 is rotatably supported by the lower frame 38 through a shaft 108A and the sprocket 110 is rotatably supported by the lower frame 38 through a shaft 110A. The shaft 110A is connected to a driving motor 114 through a power transmitting means 112 so as to transmit a rotating force as shown in FIG. 5. The lower frame 38 supports sprockets 116 so that they are rotated freely. An endless chain 118 is extended around the sprocket 108, the sprocket 110 and the sprockets 116.

The second transferring member 106 has the same construction as the first transferring member 104. Namely, the second transferring member 106 has sprockets 120, 122 wherein the sprocket 122 is rotatably supported by the lower frame 38 through a shaft 120A and the sprocket 122 is firmly attached to the shaft 122A which is rotatably supported by the lower frame 38. The shaft 122A is connected to the driving motor 114 through a power transmitting device 124 so that a rotating force is transmitted thereto as shown in FIG. 5. The lower frame 38 supports sprockets 126 so that they are freely rotatable. An endless chain 128 are extended around the sprockets 120, 122 and the sprockets 126. Accordingly, when the driving motor 114 is rotated, the sprocket 110 is turned in the direction of an arrow mark A (in the counterclockwise direction) in FIG. 4 through the power transmitting means 112 and the shaft 110A, whereby the endless chain 118 is moved in the direction of an arrow mark A1 in an area L. At the same time, the sprocket 120 is turned in the direction of an arrow mark A (in the counterclockwise direction) through the power transmitting means 124 and the shaft 120, whereby the endless chain 128 is moved in the direction of an arrow mark A2 in the area L. Guide members 118A and 128A are provided at the portions where the chain 118 opposes the chain 128 in the area L.

A speed change gear 130 is connected to the power transmitting means 112 as shown in FIG. 5. Accordingly, it is possible to change the revolution speed of an output shaft 133 by operating a revolution speed adjusting handle 132, whereby the revolution speed of the chain 118 can be changed.

The grinding apparatus for a plate-like material of the present invention has the carriers 37 as shown in FIG. 4. Each of the carriers 37 is in a disk form and has a gear 37A at its outer circumference so as to be engaged with the chains 118, 128. It also has a plurality of circular openings 37B for supporting circular glass plates 137.

A relation of the thickness L3 of each of the carriers 37 to the thickness L4 of each of the glass plates 137 is shown in FIG. 6. They are so determined to be $L3 < L4$. Accordingly, the upper surface of the glass plate 137 comes to contact with the grinding pad 54B and the lower surface of the glass plate 137 comes to contact with the grinding pad 80B. Accordingly, for instance, when the revolution speed of the chain 118 is made faster than that of the chain 128 under the condition that the gear 37A of each of the carriers 37 are engaged with the chains 118, 128, the carriers 37 are rotated in the direction of an arrow mark B and at the same time, they are moved in the direction of an arrow mark C in FIG. 4.

Since a belt conveyor 104, which is indicated by a two dotted line in FIG. 4, is provided in the lower frame 38, the carriers 37 passed through the grinding units are transferred in the direction indicated by an arrow mark so that the carriers 37 are again introduced in the grinding units.

The function of the grinding apparatus for a plate-like material of the present invention will be described.

When each of the driving motors 64 on each of the upper grinding units 32 is actuated, the rotating force is transmitted to the upper plate 54 through the shaft 66, the pulley 60, the belt 62, the pulley 58, the shaft 56 and the shaft 54A, whereby the grinding pad 54B is rotated along with the upper plate 54. At the same time, each of the driving motors 90 on each of the lower grinding units 34 is actuated, and the rotating force is transmitted to the lower plate 80 through the shaft 92, the pulley 86, the belt 88, the pulley 84, the shaft 82 and the shaft 80A, whereby the grinding pad 80B is rotated along with the lower plate 80.

Further, on the actuation of the driving motor 114 for the transferring means 36, the rotating force of the driving motor 114 is respectively transmitted to the shaft 110A and the shaft 122A through the respective power transmitting means 112, 124, whereby the sprockets 110, 120 are respectively rotated in the counterclockwise directions through the respective shafts 110A, 122A. Accordingly, the chain 118 is moved in the direction of the arrow mark A1 and the chain 128 is moved in the direction of the arrow mark A2 within the range L in FIG. 4. Under the conditions, the revolution speed adjusting handle 132 is operated so that the revolution speed of the shaft 110A is slightly faster than the revolution speed of the shaft 120A.

Then, the glass plate 137 are put in the circular openings 37B of a carrier 37, and the carrier 37 is transferred to a position a (feeding position) by the belt conveyor 140 as shown in FIG. 4. At the position a, the gear 37A of the carrier 37 is engaged with the opposing chains 118, 128. In this case, since the moving speed of the chain 118 is slightly higher than the moving speed of the chain 128, the carrier 37 is rotated in the direction of B and is moved in the direction of C. In the area L where the carrier 37 is moved by the chains 118, 128, the upper grinding units 32 and the lower grinding units 34 are placed opposing to each other and are operable. Accordingly, when the carrier is moved between the grinding pads 54B an the grinding pads 80B, the upper surface 137A of each of the glass plates 137 are ground by the grinding pads 54B and the lower surface 137B of each of the glass plates 137 is ground by the grinding pads 80B, while an abrasive agent is continuously supplied through the discharging conduits 74, 100.

When the carrier 37 reaches a position b (discharging position) in FIG. 4, the gear 37A of the carrier 37 is disengaged from the chains 118, 128, and the glass plates 137 which have been ground are removed from the carrier 37. The carrier 37 which has become empty by the removal of the glass plates 137 is again transferred by the belt conveyor 140 to the above-mentioned feeding position a where glass plates 137 to be ground are put in the carrier.

In the above-mentioned embodiment, description has been made as to use a single carrier. However, a plurality of carriers may be used so that the glass plates 137 are continuously ground by successively feeding the carriers in accordance with the steps as described above.

In the above-mentioned embodiment, the revolution speed of the chain 118 is slightly higher than the revolution speed of the chain 128. However, the chain 118 may be moved at a desired revolution speed. For instance, when the chain 118 is moved at the same revolution speed as the chain 128 but the direction of rotation is opposite, the carrier 37 undergoes only revolution but is not forwarded. It is, therefore, possible to grind glass plates for a long time at a grinding unit in this state. Further, an optimum grinding mode can be selected by changing the relative movement of the grinding pads and the glass plates.

In the above-mentioned embodiment, the circular glass plates are used. However, plate-like material such as aluminum may be polished. Further, plate-like material having a rectangular shape or another shape can be ground other than a circular plate-like material. In this text, the term grinding includes polishing.

Thus, in accordance with the present invention, carriers for supporting a plurality of plate-like materials to be ground are transferred to grinding units and are removed therefrom while the grinding units are operated, whereby the plate-like materials can be continuously ground. Accordingly, it is possible to improve productivity.

We claim:

1. A method of grinding a plate-like material which comprises:

supporting a plate-like material on a circular carrying member having a gear at its outer circumference, engaging the gear of the circular carrying member with first and second transferring means which oppose at a predetermined distance, grinding a surface of the plate-like material in a grinding unit placed at or near a transferring path which is formed between the first and second transferring means by moving the carrying member which is driven by the first and second transferring means, and moving the carrying member from the grinding unit by driving the first and second transferring means after the completion of the grinding operation.

2. The method of grinding a plate-like material according to claim 1, wherein a grinding mode is changed by changing a relative speed of driving of the first and second transferring means.

3. A grinding apparatus for grinding a plate-like material which comprises:

first and second transferring means separated by a predetermined distance to form a transferring path therebetween;

a circular carrying member having an opening for supporting said plate-like material, said circular carrying member also having a gear at its outer circumference which is simultaneously engageable with said first and second transferring means to transfer said circular carrying member and said plate-like material along said transferring path; and a grinding unit arranged at or near said transferring path so as to grind a surface of said plate-like material as it is transferred along said transferring path; wherein said gear is disengageable from said first and second transferring means at a position downstream of said grinding unit to facilitate removal of said plate-like material from said circular carrying member.

* * * * *